US012440048B2

(12) United States Patent
Smedley et al.

(10) Patent No.: US 12,440,048 B2
(45) Date of Patent: Oct. 14, 2025

(54) RETAIL MERCHANDISE SHELVING SYSTEM

(71) Applicants: Jamie A. Smedley, Hudson, OH (US); William J. Mertz, Cincinnati, OH (US)

(72) Inventors: Jamie A. Smedley, Hudson, OH (US); William J. Mertz, Cincinnati, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

(21) Appl. No.: 18/972,596

(22) Filed: Dec. 6, 2024

(65) Prior Publication Data

US 2025/0089915 A1 Mar. 20, 2025

Related U.S. Application Data

(60) Continuation of application No. 18/647,630, filed on Apr. 26, 2024, which is a division of application No. 18/096,426, filed on Jan. 12, 2023, now Pat. No. 11,998,125, which is a continuation of application (Continued)

(51) Int. Cl.

| | |
|---|---|
| ***A47F 5/10*** | (2006.01) |
| ***A47B 57/40*** | (2006.01) |
| ***A47F 5/00*** | (2006.01) |

(52) U.S. Cl.

CPC ..... *A47F 5/101* (2013.01); *A47B 57/40* (2013.01); *A47F 5/0018* (2013.01); *A47F 5/0043* (2013.01)

(58) Field of Classification Search

CPC ..... A47F 5/101; A47F 5/0018; A47F 5/0043; A47B 57/40; A47B 96/061; A47B 57/06; A47B 57/08; A47B 57/16; A47B 57/30; A47B 57/38

See application file for complete search history.

(56) References Cited

U.S. PATENT DOCUMENTS 1,354,270 A * 9/1920 Wood ..... A47B 96/061 180/68.5
1,677,764 A * 7/1928 Gloekler ..... A47J 47/16 193/38

(Continued)

FOREIGN PATENT DOCUMENTS

CN 104433528 A 3/2015
CN 207921581 U 9/2018

(Continued)

*Primary Examiner* — Devin K Barnett

(74) *Attorney, Agent, or Firm* — Reinhart Boerner Van Deuren P.C.

(57) ABSTRACT

Shelve brackets and shelf arrangements are provided. First and second brackets are provided. Each bracket has a support section, a mounting section and a transition section. The mounting section is laterally offset from the support section. The support section includes a vertical, top and bottom flange portions. The top and bottom flange portions are vertically spaced and extend from a first side of vertical flange portion in a direction the support section is offset from the mounting section. The transition section of the first bracket offsets the support section of the first bracket towards the second bracket and the transition section of the second bracket offsetting the support section of the second bracket towards the first bracket.

23 Claims, 16 Drawing Sheets

Related U.S. Application Data

No. 17/231,501, filed on Apr. 15, 2021, now Pat. No. 11,583,110.

(60) Provisional application No. 63/014,395, filed on Apr. 23, 2020.

(56) References Cited

U.S. PATENT DOCUMENTS 2,091,599 A * 8/1937 Larson ..... B60R 5/003 211/90.03
2,191,701 A * 2/1940 Wood ..... A47F 5/0838 248/245
2,633,998 A * 4/1953 Derman ..... A47G 25/08 108/29
2,790,559 A * 4/1957 Stephenson ..... A47B 96/028 108/108
2,940,601 A * 6/1960 Smith ..... A47B 96/021 108/157.13
3,185,426 A * 5/1965 Bjerke ..... A47B 96/061 211/187
3,237,779 A * 3/1966 Eger ..... A47B 57/30 403/230
3,285,428 A * 11/1966 Scheck ..... A47B 57/06 52/666
3,297,374 A * 1/1967 Radek ..... A47F 5/103 312/334.47
3,298,503 A * 1/1967 Field ..... B65D 85/185 211/124
3,302,800 A * 2/1967 Zdanowski ..... B65D 85/185 206/291
3,403,787 A * 10/1968 Browning ..... A47B 61/003 211/124
D214,923 S * 8/1969 Schier ..... D6/566
3,465,891 A * 9/1969 De Rose ..... H02B 1/00 211/41.17
3,556,306 A * 1/1971 Shell ..... A47B 96/021 211/187
3,610,427 A * 10/1971 Maziarka ..... B65D 85/185 206/290
3,827,574 A 8/1974 Craig, Sr.
3,891,091 A * 6/1975 Anderson ..... A47H 1/144 211/105.3
3,986,462 A * 10/1976 Heft ..... A47B 96/02 211/188
4,018,167 A * 4/1977 Spangler ..... A47B 96/061 248/250
4,078,664 A * 3/1978 McConnell ..... A47B 96/00 211/187
4,118,087 A * 10/1978 Dorf ..... A47B 45/00 211/105.6
4,250,679 A * 2/1981 Burg ..... F16B 12/28 52/654.1
4,431,155 A * 2/1984 Engel ..... A47B 96/061 108/108
4,455,007 A * 6/1984 Varon ..... A47B 96/061 248/300
4,665,838 A * 5/1987 Minshall ..... A47B 47/021 211/186
4,760,930 A * 8/1988 Fox ..... A47B 96/07 248/250
4,785,945 A 11/1988 Rowse et al.
4,874,148 A * 10/1989 Guinter ..... A47B 57/42 248/220.22
4,955,490 A * 9/1990 Schafer ..... A47B 96/02 211/187
5,253,837 A * 10/1993 Loux ..... A47G 25/0692 211/90.01
5,257,701 A * 11/1993 Edelson ..... A47B 3/10 482/148
5,277,393 A * 1/1994 Nicholson ..... A47B 95/008 248/223.41
5,279,431 A * 1/1994 Highsmith ..... B65G 1/02 211/187
5,310,066 A * 5/1994 Konstant ..... A47B 47/022 211/187
5,356,106 A * 10/1994 Trotta ..... A47B 57/482 248/250
5,628,415 A * 5/1997 Mulholland ..... A47B 47/027 211/186
5,921,411 A * 7/1999 Merl ..... A47B 96/027 211/94.01
6,105,798 A * 8/2000 Gruber ..... B65G 1/02 211/151
6,168,032 B1 * 1/2001 Merl ..... A47B 96/061 248/242
6,234,328 B1 * 5/2001 Mason ..... A47F 5/0037 248/242
6,257,425 B1 * 7/2001 Liu ..... A47K 10/04 211/90.01
6,257,427 B1 * 7/2001 Schneid ..... A47B 47/028 211/189
6,405,557 B1 * 6/2002 DeCastro ..... B65D 1/36 62/457.2
6,962,116 B2 * 11/2005 Bienick ..... F25D 25/02 108/108
7,150,364 B2 * 12/2006 Jablow ..... A47B 45/00 211/175
7,300,122 B2 * 11/2007 Vardon ..... A47F 3/0486 108/108
7,644,827 B2 1/2010 Hanretty
7,654,497 B1 * 2/2010 Karan ..... A47F 5/13 248/250
7,784,413 B2 * 8/2010 Gabriel ..... A01K 1/031 108/60
7,810,487 B2 * 10/2010 Johnston ..... A47J 37/0694 126/152 A
8,087,522 B2 * 1/2012 Stafford ..... A47F 5/10 211/119.003
8,627,966 B2 * 1/2014 Jarvis ..... A47B 57/545 211/187
8,899,162 B2 * 12/2014 Chikkakalbalu ..... A47B 96/021 108/108
8,905,248 B1 * 12/2014 Wolski ..... A47B 57/26 211/90.03
9,027,767 B2 * 5/2015 Buckley ..... A47B 57/34 211/134
9,119,471 B2 * 9/2015 Gonzalez ..... A47B 96/061
9,289,065 B1 * 3/2016 Lambertson ..... A47K 10/04
9,375,102 B2 * 6/2016 Troyner ..... A47F 5/01
9,445,669 B2 * 9/2016 Li ..... A47B 96/021
9,468,312 B2 * 10/2016 Denby ..... A47F 5/108
9,486,090 B2 * 11/2016 Juric ..... A47F 5/0093
D803,671 S * 11/2017 Neelagantan ..... D8/381
10,021,972 B1 * 7/2018 Robinson ..... A47B 57/30
10,051,959 B1 * 8/2018 Glidewell ..... A47B 61/02
10,206,506 B1 * 2/2019 Lai ..... A47B 96/1433
10,334,970 B2 * 7/2019 Buck ..... A47B 57/406
10,638,856 B2 * 5/2020 Nagel ..... A47F 5/0025
10,709,237 B2 * 7/2020 Robinson ..... A47B 96/028
10,905,239 B2 * 2/2021 Newman ..... A47B 96/028
11,268,284 B2 * 3/2022 Ohrstrom ..... E04F 11/1817
11,369,215 B2 * 6/2022 Obitts ..... A47B 96/021
11,612,245 B2 3/2023 Meiser
2003/0132182 A1 7/2003 Jay
2005/0127017 A1 * 6/2005 Kessel ..... A47B 57/06 211/187
2005/0263465 A1 * 12/2005 Chung ..... A47F 3/063 211/90.02
2007/0221103 A1 * 9/2007 Trausch ..... A47B 57/045 108/108
2008/0272076 A1 * 11/2008 Davenport ..... A47B 57/42 211/90.01
2009/0223912 A1 * 9/2009 Chen ..... A47K 10/10 211/48
2010/0065523 A1 3/2010 Northrup, Jr. et al.
2010/0133219 A1 6/2010 Sun
2010/0213334 A1 * 8/2010 Davenport ..... A47B 57/16 248/220.21

(56) References Cited

U.S. PATENT DOCUMENTS

| | | | | |
|---|---|---|---|---|
| 2011/0147323 | A1* | 6/2011 | Sainato | A47F 1/12 40/642.02 |
| 2011/0186533 | A1* | 8/2011 | Thrush | A47B 96/025 211/113 |
| 2011/0204014 | A1* | 8/2011 | Miller | A47B 5/00 108/42 |
| 2015/0027972 | A1* | 1/2015 | Andersson | A47B 96/1408 211/94.01 |
| 2015/0173528 | A1* | 6/2015 | Hester-Redmond | F21V 33/0012 211/26 |
| 2016/0106235 | A1 | 4/2016 | Mason | |
| 2017/0071364 | A1* | 3/2017 | Turner | A47F 5/0043 |
| 2018/0153316 | A1* | 6/2018 | Buck | A47F 5/103 |
| 2019/0387902 | A1 | 12/2019 | Peck et al. | |
| 2020/0187675 | A1* | 6/2020 | Obitts | A47F 1/12 |
| 2021/0199490 | A1* | 7/2021 | Fritsch | G01G 19/52 |
| 2021/0330081 | A1* | 10/2021 | McMillin | A47B 96/027 |

FOREIGN PATENT DOCUMENTS

| | | | |
|---|---|---|---|
| JP | 2014212874 | A | 11/2014 |
| KR | 20070109517 | A | 11/2007 |

* cited by examiner

RETAIL MERCHANDISE SHELVING SYSTEM

CROSS-REFERENCE TO RELATED PATENT APPLICATIONS

This Patent Application is a Continuation of U.S. patent application Ser. No. 18/647,630, filed Apr. 26, 2024, which is now pending, which is a Divisional of U.S. patent application Ser. No. 18/096,426, filed Jan. 12, 2023, which issued as U.S. Pat. No. 11,998,125 on Jun. 4, 2024, which is a Continuation of U.S. patent application Ser. No. 17/231,501, filed Apr. 15, 2021, which issued as U.S. Pat. No. 11,583,110 on Feb. 21, 2023, which claims the benefit of U.S. Provisional Patent Application No. 63/014,395, filed Apr. 23, 2020, the entire teachings and disclosures of all applications are incorporated herein by reference thereto.

FIELD OF THE INVENTION

This invention generally relates to retail displays, and more particularly to retail shelving systems.

BACKGROUND OF THE INVENTION

Retail shelving is a staple in the retail merchandise environment. While such shelving comes in many forms, it generally includes a vertical support structure which supports one or more shelves extending outwardly from the vertical structure. The vertical structure is typically a wall-like structure and contains integrated mounting rails, referred to in in the industry as uprights and more particularly gondola uprights, which the shelves mount to. A particular embodiment of such an arrangement is provided in U.S. patent application Ser. No. 16/222,722 filed on Dec. 17, 2018, and assigned to the owner of the instant application.

The shelves of these displays will typically include a frame that includes include outward extending brackets for each shelf with laterally extending support bars extending between the brackets. The brackets will have mounting features for adjustably mounting the shelves to the uprights.

Unfortunately, when the shelves are used to display items such as food, the shelves need to be cleaned. However, if the spacing between adjacent shelves is inadequate, e.g. less than 1 inch, it can be difficult to properly clean all relevant surfaces of the shelves without having to remove every other laterally adjacent shelf to provide access to the end surfaces of the shelves.

Further in some implementations, the laterally extending support bars may be affixed to the brackets in such a way that the ends of the support bars are exposed. Unfortunately, to reduce weight and material cost, these support bars are typically tubular, at least at their ends, such that food or other debris can get in the support bars and can be difficult to clean, again at least without removing them from the uprights.

Unfortunately, removing and then reinstalling the shelves from the uprights for cleaning purposes can take significant amounts of time, particularly if the cleaning activity is being done by a single person.

Accordingly, there is a need in the art for a retail shelving system which addresses the above drawbacks of existing shelving systems.

BRIEF SUMMARY

Examples provide new and improved retail merchandise displays and particularly new and improved shelf systems.

In an example, a shelf arrangement including first and second uprights and first and second brackets is provided. The first upright includes a first column of slots formed in a front face thereof. The second upright includes a second column of slots formed in a front face thereof. The second upright is positioned adjacent the first upright. The first and second brackets each includes a support section, a mounting section and a transition section. The bracket defines a first side and an opposed second side. The transition section laterally offsets the mounting section from the support section. The support section includes a vertical flange portion, a top flange portion, and a bottom flange portion. The top flange portion extends from the first side of vertical flange portion in a direction the transition section offsets the support section from the mounting section. The bottom flange portion extends from the first side of the vertical flange portion in the direction the transition section offsets the support section from the mounting section. The bottom flange portion is spaced apart from the top flange (e.g. vertically). The mounting section of the first bracket mounting the bracket to the first upright. The mounting section of the second bracket mounting the bracket to the second upright. The first side of the first bracket faces way from the second bracket. The first side of the second bracket face way from the first bracket. The first and second brackets forming a space between the second side of the first bracket and second side of the second bracket.

In one example, the mounting section of the first bracket is laterally spaced from the mounting section of the second bracket less than or equal to 0.75 inch and the support section of the first bracket is laterally spaced form the support section of the second bracket is at least 1 inch.

In one example, the first and second uprights are formed from a same piece of material.

In one example, the first upright and second upright are formed from separate components. A lateral spacing between the first and second uprights is no greater than 0.5 inches and optionally no greater than 0.25 inches.

In one example, for each of the first and second brackets: the top flange portion extends from a rear end proximate the transition section toward a front end proximate a distal end of the bracket. The bottom flange portion extends from a rear end proximate the transition section toward a front end proximate the distal end of the bracket. A first vertical spacing between the rear end of the top flange portion and the rear end of the bottom flange portion is greater than a second vertical spacing between the front end of the top flange portion and the front end of the bottom flange portion.

In one example, the top and bottom flange portions of the first bracket extend from the vertical flange portion in a direction that extends away from the second bracket. The top and bottom flange portions of the second bracket extend from the vertical flange portion in a direction that extends away from the first bracket.

In one example, the support section of the first bracket is free of any flange that extends past the vertical flange portion towards the second bracket. The support section of the second bracket is free of any flange that extends past the vertical flange portion towards the first bracket.

In one example, for each of the first and second brackets, the top flange portion is connected to the vertical flange portion by a first bend and the bottom flange portion is connected to the vertical flange portion by a second bend.

In one example, the first bracket has a first length defined between a first end defined by an end of the support section and a second end defined by the mounting section. The support section defines at least 75% of the first length. The second bracket has a second length defined between a first end defined by an end of the support section and a second end defined by the mounting section. The support section defines at least 75% of the second length.

In one example, for each of the first and second brackets, the support section, mounting section and transition section are all formed from a single unitary piece of material, with a first bend formed between and connecting the transition section and the support section, and with a second bend formed between and connecting the transition section and the mounting section.

In one example, a first end of the support bar is attached to the vertical flange portion of the first bracket vertically between the top flange portion and the bottom flange portion of the first bracket. A second opposed end of the support bar is attached to the vertical flange portion of the second bracket vertically between the top flange portion and the bottom flange portion of the second bracket.

In one example, the support bar includes first and second mounting stubs and a connection bar interconnected between the first and second mounting stubs. The first and second mounting stubs are tubular elements. An end of the first mounting stub is attached to the vertical flange portion of the first bracket such that the vertical flange portion closes off the end of the first mounting stub. An end of the second mounting stub is attached to the vertical flange portion of the second bracket such that the vertical flange portion closes off the end of the second mounting stub.

In one example, the first mounting stub is T-welded to the vertical flange portion of the first bracket and the second mounting stub is T-welded to the vertical flange portion of the second bracket.

In an example of cleaning a system as outlined herein is provided. The method includes cleaning within the gap formed between the first and second brackets without removing the first bracket from the first upright and without removing the second bracket from the second upright.

In an example, a bracket for a shelf for use in a shelf arrangement to be mounted to a vertical upright is provided. The bracket includes a support section, a mounting section and a transition section. The bracket defines a first side and an opposed second side. The transition section laterally offsets the mounting section from the support section at least one-half inch. The support section includes a vertical flange portion, a top flange portion, and a bottom flange portion. The top flange portion extends from the first side of vertical flange portion in a direction the transition section offsets the support section from the mounting section. The bottom flange portion extends from the first side of the vertical flange portion in the direction the transition section offsets the support section from the mounting section. The bottom flange portion is spaced apart from the top flange, vertically.

In one example, the support section is free of any flange portion that extends from the vertical flange portion laterally in a direction opposite the top and bottom flange portions.

In an example, a bracket for a shelf for use in a shelf arrangement to be mounted to a vertical upright is provided. The bracket includes a support section, a mounting section and a transition section. The bracket defines a first side and an opposed second side. The transition section laterally offsets the mounting section from the support section. The support section includes a vertical flange portion, a top flange portion and a bottom flange portion. The top flange portion extends from the first side of vertical flange portion in a direction the transition section offsets the support section from the mounting section. The bottom flange portion extends from the first side of the vertical flange portion in the direction the transition section offsets the support section from the mounting section. The bottom flange portion is spaced apart from the top flange, vertically. The support section is free of any flange portion that extends from the vertical flange portion laterally in a direction opposite the top and bottom flange portions.

In examples, the support section, mounting section and transition section are formed from a single continuous piece of material.

In examples, the support section is formed from a different component than the mounting section. The support section being pivotably attached to the mounting section to allow for changing the orientation of the support section relative to the mounting section.

In an example, a shelf system including first and second shelves is provided. The first shelf has a bracket at a first end of the first shelf. The bracket has a support section extending rearward from a front of the first shelf at least 85% of a depth of the first shelf from the front to a rear of the first shelf. The second shelf has a bracket at a first end of the second shelf. The bracket has a support section extending rearward from a front of the second shelf at least 85% of a depth of the second shelf from the front to a rear of the second shelf. The first end of the first shelf is adjacent the first end of the second shelf. A minimum spacing between the support sections of the first and second shelves being at least 1 inch and preferably at least 1.25 inches. The support sections defining the outer faces of the brackets that face the adjacent shelf.

In one example, the bracket of the first shelf has a mounting section that is laterally offset towards the second shelf. The mounting section is rearward of the support section. The bracket of the second shelf has a mounting section that is laterally offset towards the first shelf. The mounting section is rearward of the support section.

In one example, the front of the first shelf is aligned with the front of the second shelf and the depth of the first shelf is the same as the depth of the second shelf.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION

Figure 1:
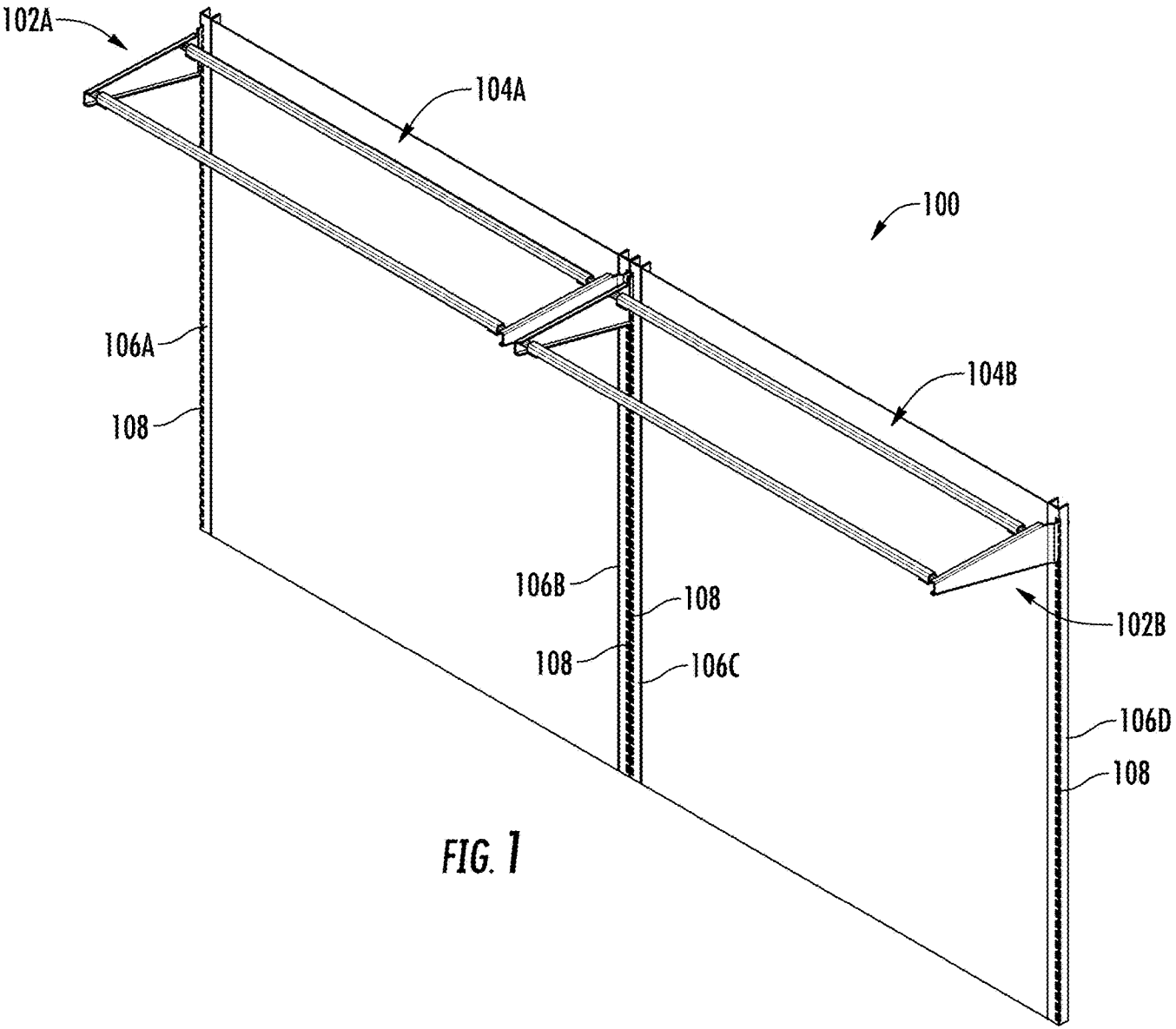
FIG. 1 is a front perspective view of an example of a retail merchandise display according to an example.

FIG. 1 illustrates a retail merchandise display in the form of a shelf arrangement 100 in simplified form.

Figure 10:
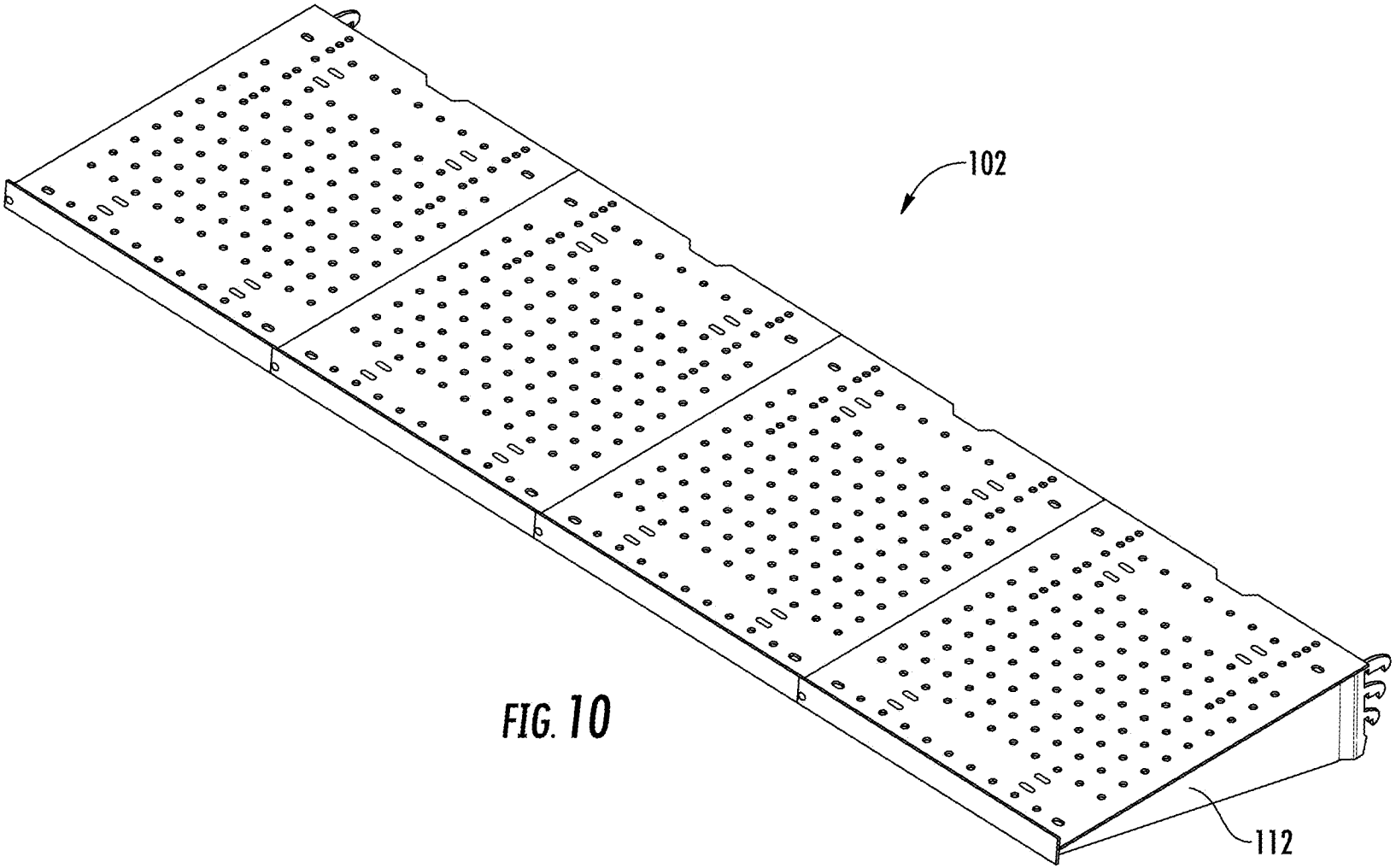
FIGS. 10 and 11 illustrate the shelf of FIG. 1 with deck panels attached thereto.
Figure 11:
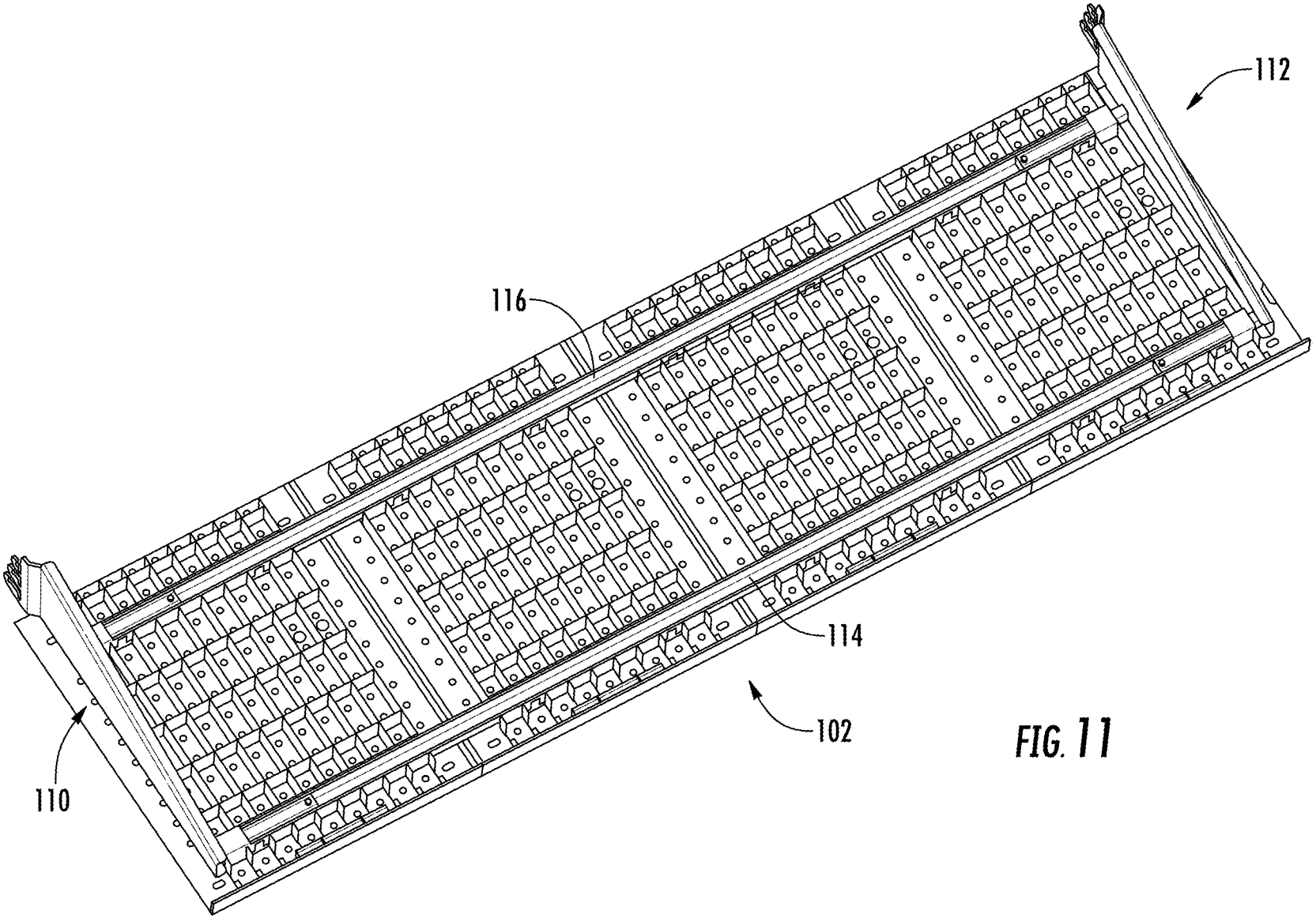

The shelf arrangement 100 includes a plurality of shelves 102A and 102B. The shelves 102A, 102B each include a frame 104A, 104B and a top deck that is not illustrated in FIG. 1, but is illustrated in FIGS. 10 and 11. The top deck is mounted to the top of the frame 104A, 104B. Merchandise to be displayed is located on the top deck.

The shelf arrangement includes four uprights 106A-D. Shelf 102A is mounted to uprights 106A and 106B while shelf 102B is mounted to uprights 106C, 106D.

Figure 8:
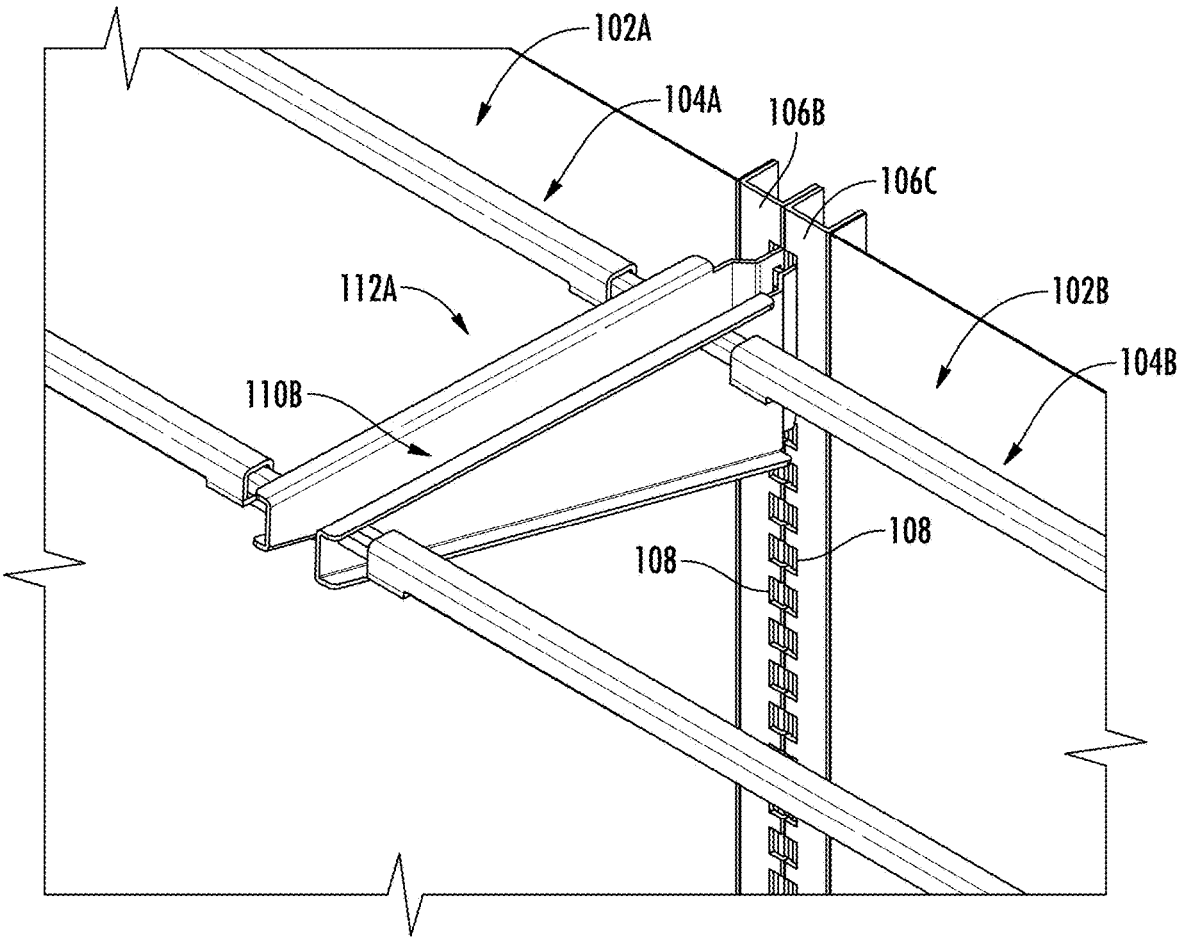
FIG. 8 is an enlarged perspective view of two adjacent brackets of adjacent shelves of the retail merchandise display of FIG. 1.

Each upright 106A-D includes vertical column of slots 108 formed in a front face of the upright 106A-D (see also FIG. 8). In the illustrated embodiment, upright 106B and upright 106C are adjacent one another. Preferably, these two uprights 106B, 106C are touching or spaced no more than 0.25 inches apart. The slots 108 allow the vertical position of the shelves 102A, 102B to be adjusted by changing the slots 108 in which the frames 104A, 104B mount.

Shelves 102A and 102B are substantially identical so only a single shelf will be described but the features thereof will be universal between the two shelves 102A, 102B. Further, while two shelves 102A, 102B are illustrated, multiple shelves could be employed. Typically, there will be multiple vertically spaced shelves in the shelf arrangement 100.

The shelves 102A, 102B, and particularly the frames 104A, 104B thereof are configured to promote easier cleaning of the frames 104A, 104B and particularly between the adjacent shelves 102A, 102B and more particularly without requiring removal of the components of frames 104A, 104B.

Figure 2:
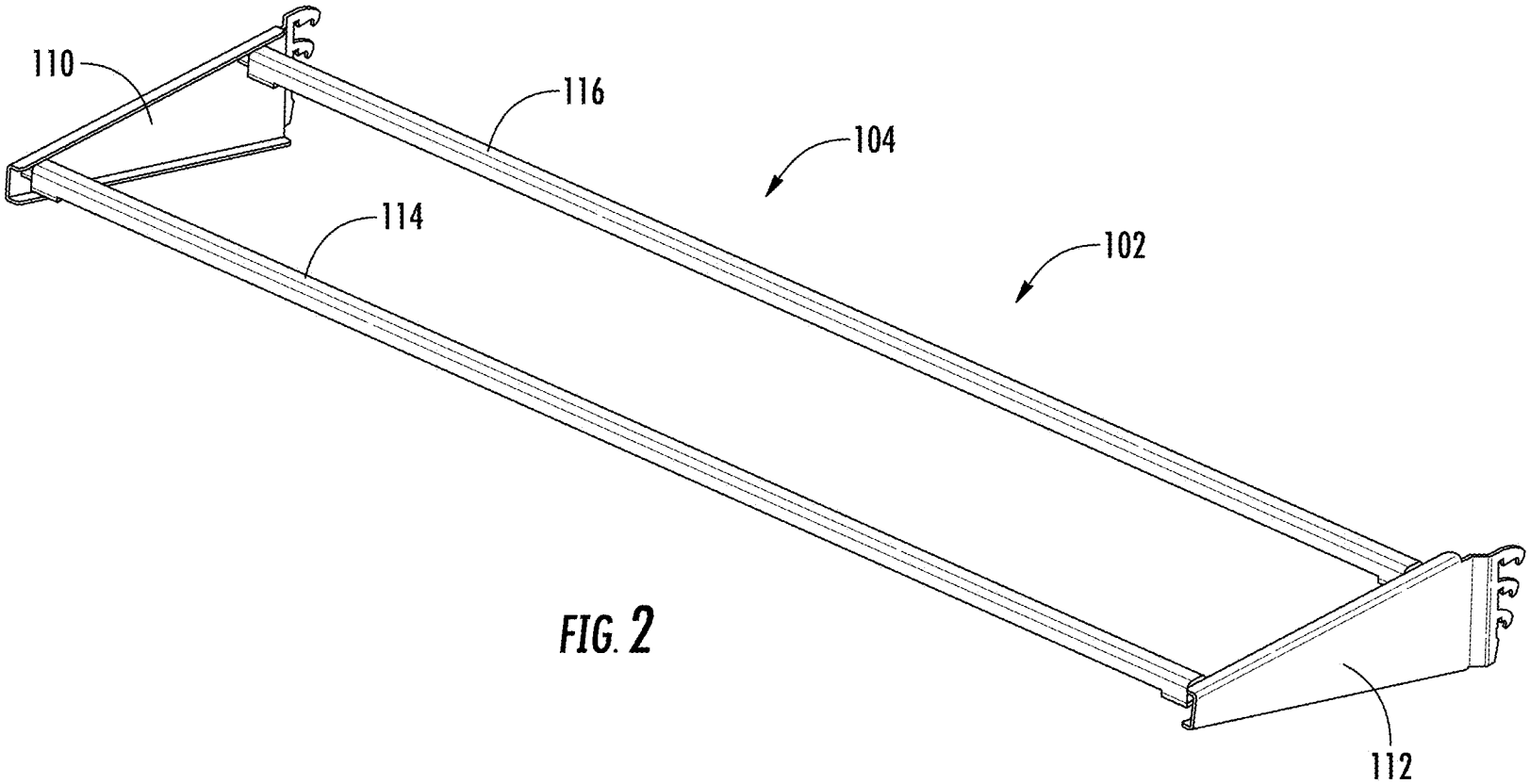
FIG. 2 is a front perspective view of a frame of a shelf of the retail merchandise display of FIG. 1.

FIG. 2 illustrates a frame 104 of a shelf 102 removed from the uprights 106. The frame includes opposed brackets 110, 112 (also referred to as support arms) and a pair of support bars 114, 116. The support bars 114, 116 extend laterally between and interconnect brackets 110, 112.

The brackets 110, 112 extend longitudinally between a front end and a rear end. This longitudinal direction is generally perpendicular to the front face of the uprights 106 and perpendicular to the lateral directions along which the support bars 114, 116 extend between adjacent brackets 110, 112 of a corresponding shelf 102.

Figure 3:
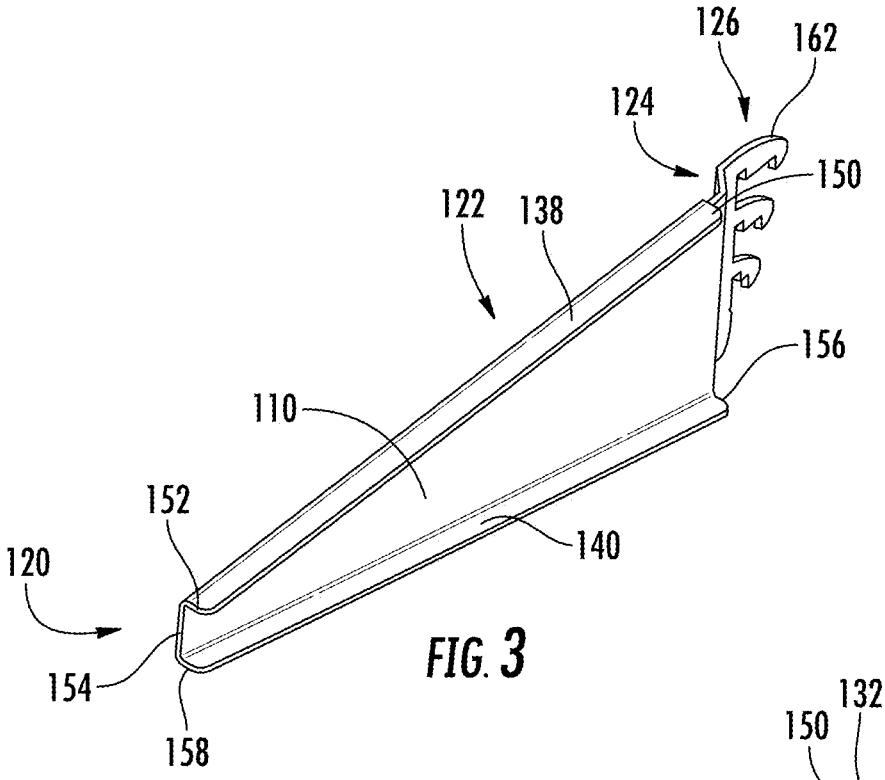
FIG. 3 is a perspective view of a bracket of the shelf frame of FIG. 2.
Figure 4:
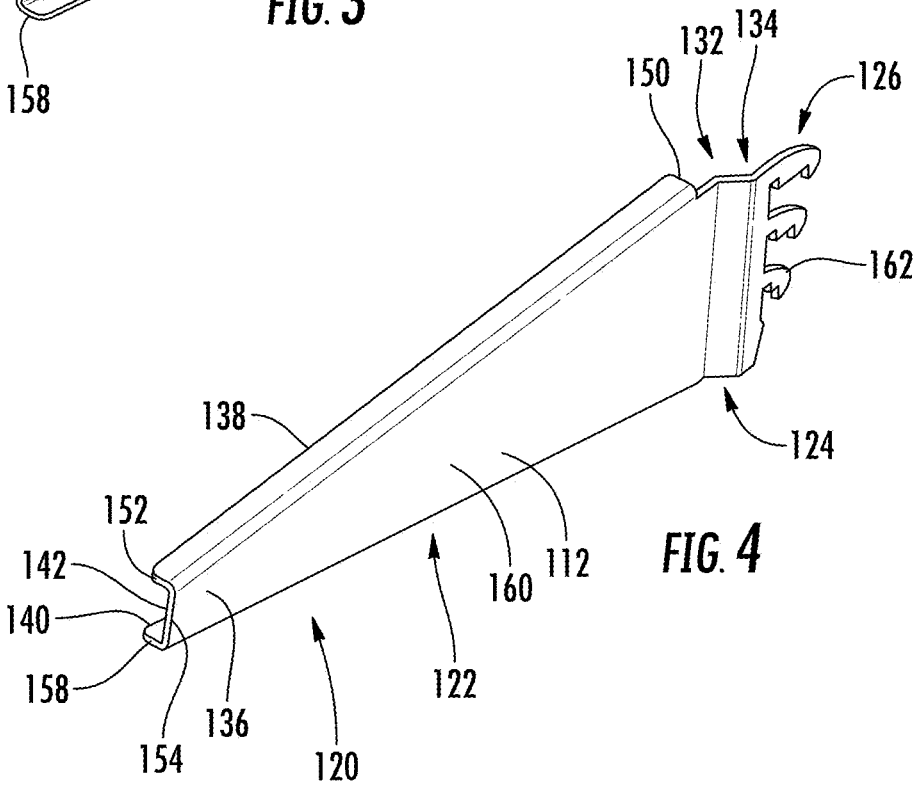
FIG. 4 is a perspective view of a second bracket of the shelf frame of FIG. 2 for the opposed end of the shelf frame.

FIGS. 3 and 4 illustrate the brackets 110, 112 with the support bars 114, 116 removed. Brackets 110, 112 are substantially mirror images of one another. Each bracket includes a body portion 120 that includes a support section 122, a transition section 124 and a mounting section 126. In this embodiment, the support section 122, transition section 124 and the mounting section 126 are formed from a continuous piece of material.

The transition section 124 is interposed between the mounting section 126 and the support section 122. The transition section 124 is angled relative to both of the support section 122 and the mounting section 126 to laterally offset the support section 122 from the mounting section 126. More particularly bend 132 interconnects support section 122 and transition section 124 and bend 134 connects the opposed end of the transition section 122 to the mounting section 126. In the illustrated example, bends 132, 134 bend in opposite directions relative to one another to provide the desire offset orientation.

In the illustrated embodiment, the body portion 120 is a single piece of material that forms the entirety of the portions of bracket 110 or bracket 112. Preferably, the brackets 110, 112 are formed from stamped plate metal.

Each support section 122 includes a vertical flange portion 136, a top flange portion 138, and a bottom flange portion 140. The top flange portion 138 extends from an inner side 142 of the bracket 112 and from a top of the vertical flange portion 136. The bottom flange 140 extend from an inner side 142 of the bracket 112 and from a bottom of the vertical flange portion 136 such that the top and bottom flange portions 138, 140 are vertically spaced from one another.

The top and bottom flange portions 138, 140 extend from the vertical portion 136 a same direction that the transition section 124 offsets the support section 122 from the mounting section 126. For an individual shelf, the transition section 124 offsets the support section 122 inward of the mounting section 126, e.g. toward the bracket on the other end of the shelf. Similarly, the top and bottom flange portions 138, 140 extend inward from the vertical flange portion 136, e.g. toward the bracket on the other end of the shelf.

The top flange portion extends from a rear end 150 that is proximate the transition section 124 toward a front end 152 that is proximate a distal end 154 of the body portion 120. The bottom flange portion 140 extends from a rear end 156 proximate transition section 124 toward a front end 158 that is proximate distal end 154 of the body portion 120. The support section 122 tapers from the transition section 124 to the distal end 154. More particularly a vertical spacing between the rear ends 150, 156 is greater than a vertical spacing between the front ends 152, 158.

It is noted that in the illustrated example, the support section 122 is free of any flange portions that extend outward, e.g. from outer side 160 of the body portion 120, which is opposite inner side 142.

The mounting section 126 includes mounting features for releasably securing the brackets 110, 112 to the uprights 106 and particularly for releasable mounting engagement with slots 108 such that the vertical position of the shelf relative to the uprights 106 can be adjusted.

In the illustrated example, the mounting features are in the form of hooks 162 that insert into slots 108 and engage the upright 106.

Figure 5:
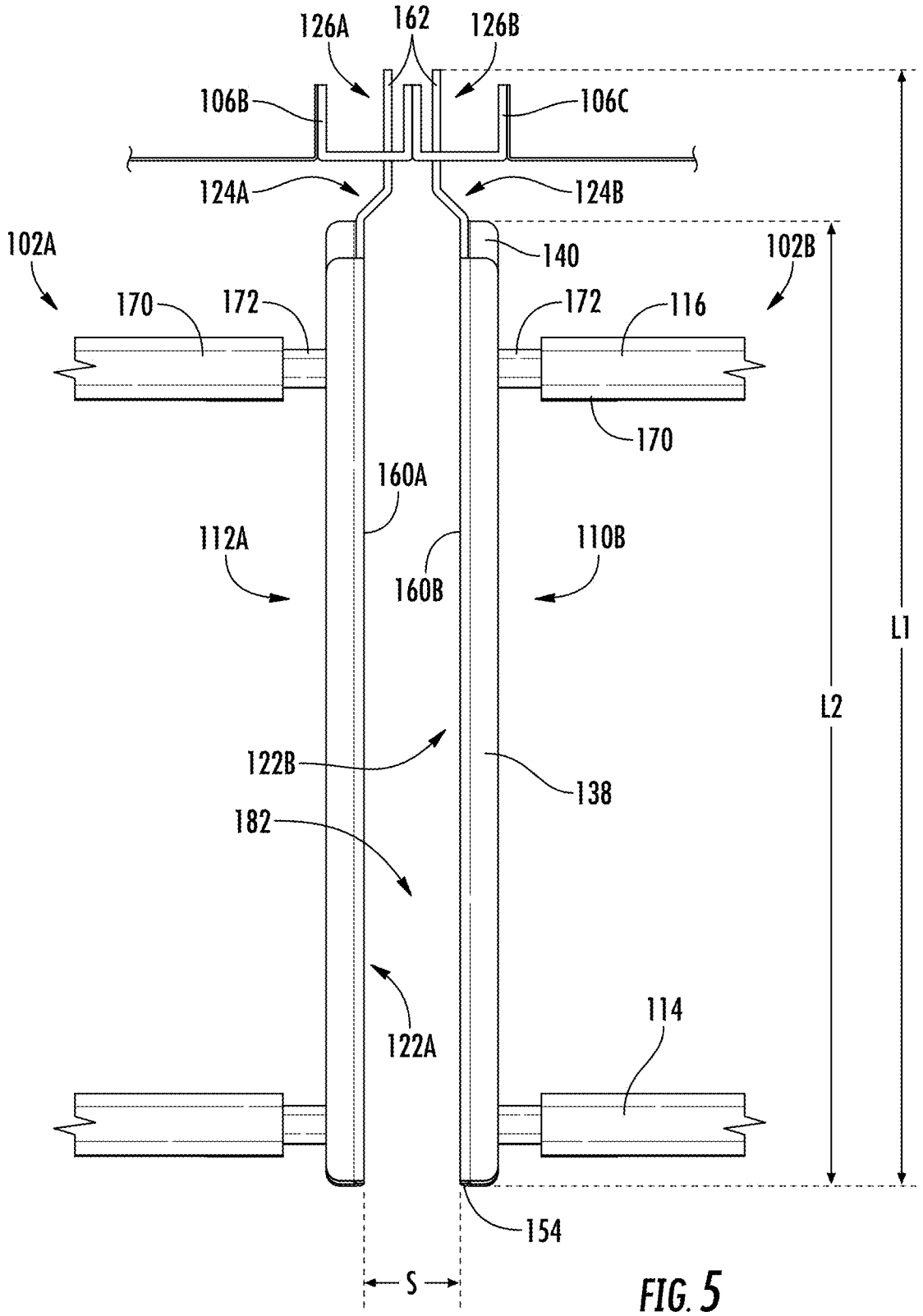
FIG. 5 is a top view of adjacent shelf brackets of adjacent shelves of the retail merchandise display of FIG. 1.

With reference to FIG. 5, the brackets 110, 112 have a length L1 from the rear end defined by the end of the hooks 162 to distal end 154. The support section 122 has length L2 from the rear end to the front end (e.g. distal end 154). The length L2 is at least 75% of the length L1 and in some examples at least 85% of the length L1.

Figure 6:
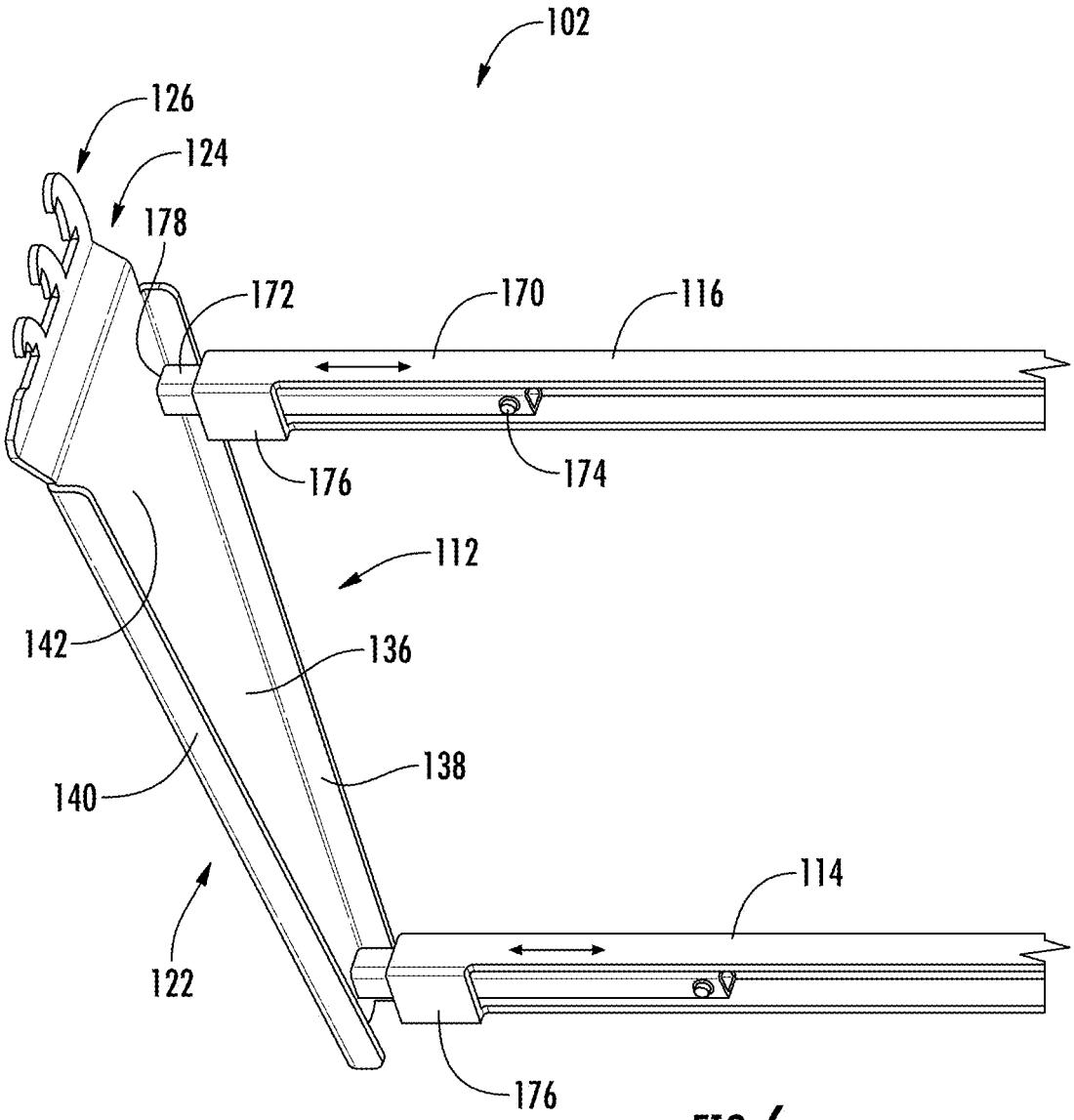
FIG. 6 is a partial rear bottom perspective view of the shelf frame of FIG. 2.
Figure 7:
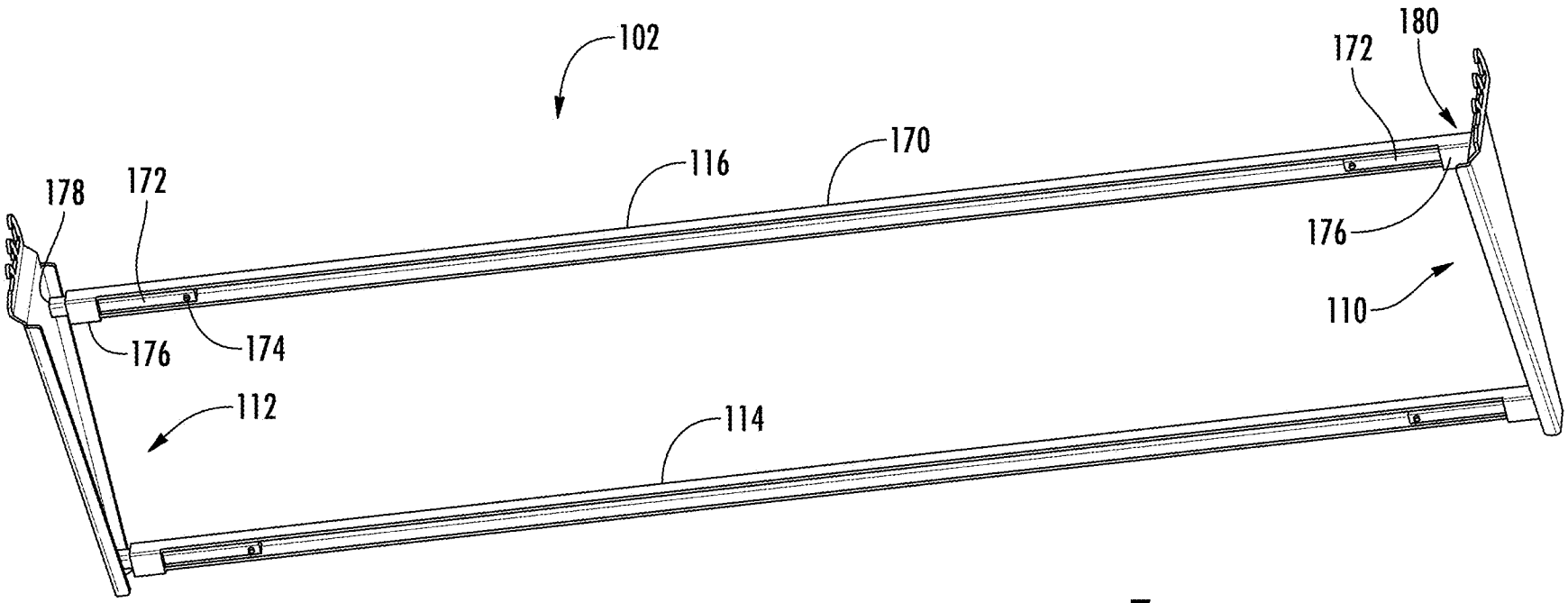
FIG. 7 is a rear bottom perspective view of the shelf frame of FIG. 2.
Figure 9:
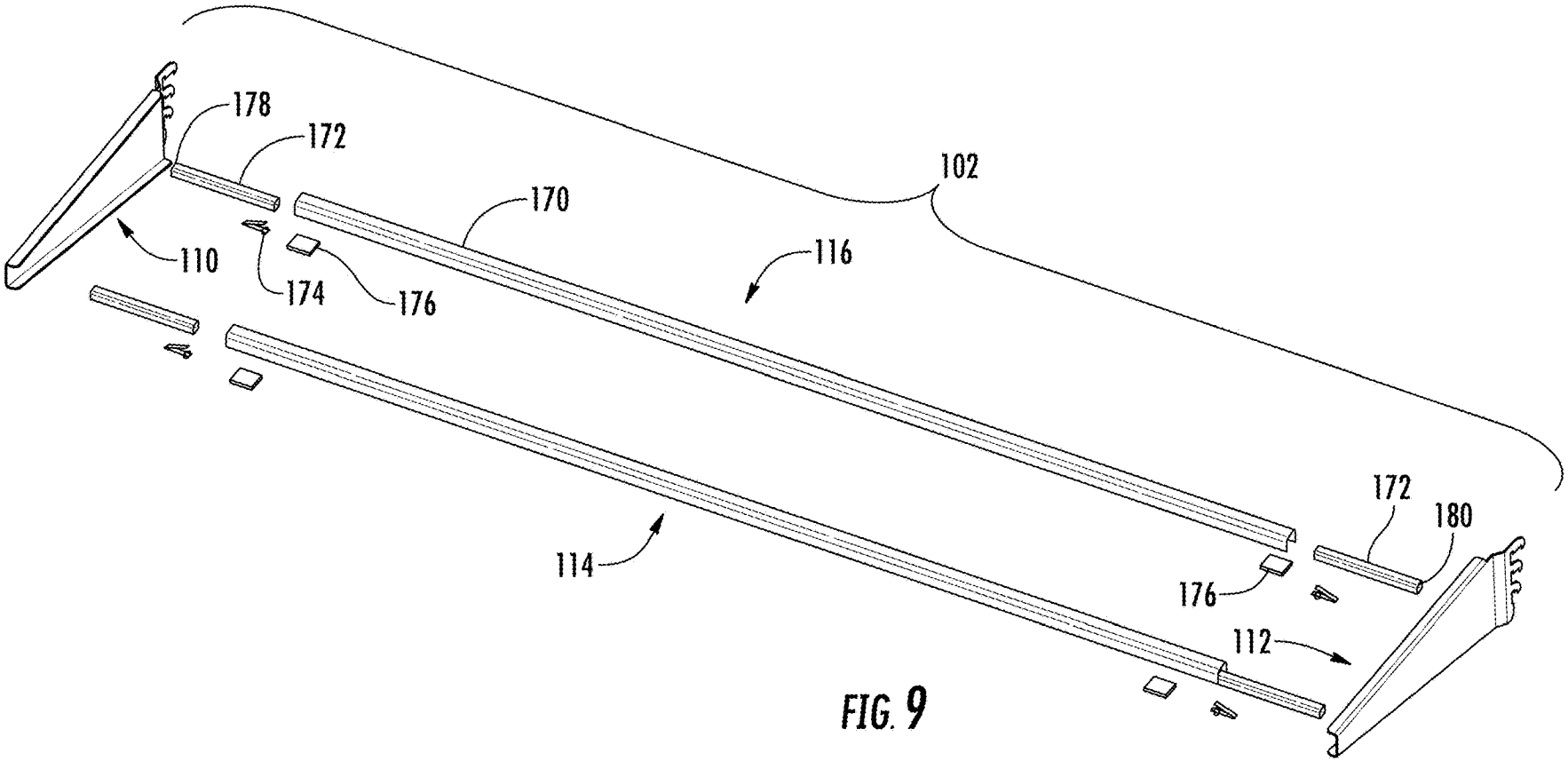
FIG. 9 is an exploded illustration of the shelf frame of FIG. 2.

With reference to FIGS. 6, 7 and 9, in an example, the support bars 114, 116 are formed from multiple components. It is noted that in the illustrated example, support bars 114, 116 are identical so only support bar 116 will be described. Support bar 116 includes a connection bar 170 that is substantially U-shaped along 90% or more of its length. The support bar 116 includes mounting stubs 172, at opposed ends. The mounting stubs 172 are received into ends of the connection bar 170. In this example, the mounting stubs are formed from rectangular tubing.

The mounting stubs 172 may include a push button 174. The connection bar 170 has tabs 176 to form openings in the ends of connection bar 170. The push buttons 174 secure the stubs 172 within the connection bar 170. Notably, the connection bar 170 and stubs 172 are generally allowed to float relative to one another (e.g. the push buttons 174 do not lock into the connection bar 170 to provide a fixed length.

The support bar extends between first and second ends 178, 180. These ends 178, 180 are attached to the inner sides of the brackets 110, 112. This is illustrated by end 178 of support bar 116 in FIG. 6.

In a preferred example, the ends 178 are T-welded to the inner side 142 and particularly to the vertical flange portion 136. This arrangement closes the opening that would otherwise be formed by stub 172 being formed by tubing. This arrangement prevents food or other materials from getting into the tubing which can cause problems as well as difficulties cleaning when the shelves are used for food products, and particularly for food products such as meat or produce.

Further, with reference to FIG. 6, it is illustrated that the connection between the end 178 of the support bar 116 and the bracket 112 is formed vertically between the top and bottom flange portions 138, 140.

In the illustrated example, the upper most surface of the mounting stubs 172 are mounted against a bottom most surface of the top flange portion 138.

While uprights 106B, 106C are illustrated as separate components, they could be formed from a single component with at least a pair of vertical columns of slots 108.

The configuration of the opposed brackets of a shelf 102 are such that when two similar shelves are mounted laterally adjacent one another, see e.g. shelves 102A and 102B in FIGS. 1 and 5, a gap 182 is formed between the support sections 122A, 122B. Preferably, this gap has a lateral spacing S that is at least 1 inch, preferably at least 1.25 inches when the corresponding uprights 106B, 106C contact one another and the shelves 102A, 102B are mounted to the corresponding pairs of uprights 106A, 106B and 106C, 106D. This spacing of at least 1 inch allows for easy access for cleaning of the outer sides 160A, 160B of the immediate adjacent brackets 112A, 110A. Further by having the top and bottom flange portions 138, 140 bent/extending inward, i.e. away from the immediate adjacent flange of an adjacent shelf or toward the other bracket of the same shelf, rather than outward, this spacing and ease of access for cleaning is maintained. This is a significant improvement over prior art brackets that had one or both of the top and bottom flanges extending outward.

In one embodiment, the transition section 124 offsets the support section 122 from the mounting section 126 at least one-half inch measured form the outer side of the support section to the outer side of the mounting section. Thus, when two brackets are positioned adjacent one another such as in the system described herein, the two adjacent brackets would provide at least the 1 inch spacing S between the adjacent shelves.

Further, by using the T-welded ends of the support brackets 114, 116 and particularly the mounting stubs 172 thereof, debris is not trapped inside the tubular mounting stubs 172 further improving the clean ability and cleanliness of the shelves.

Figure 12:
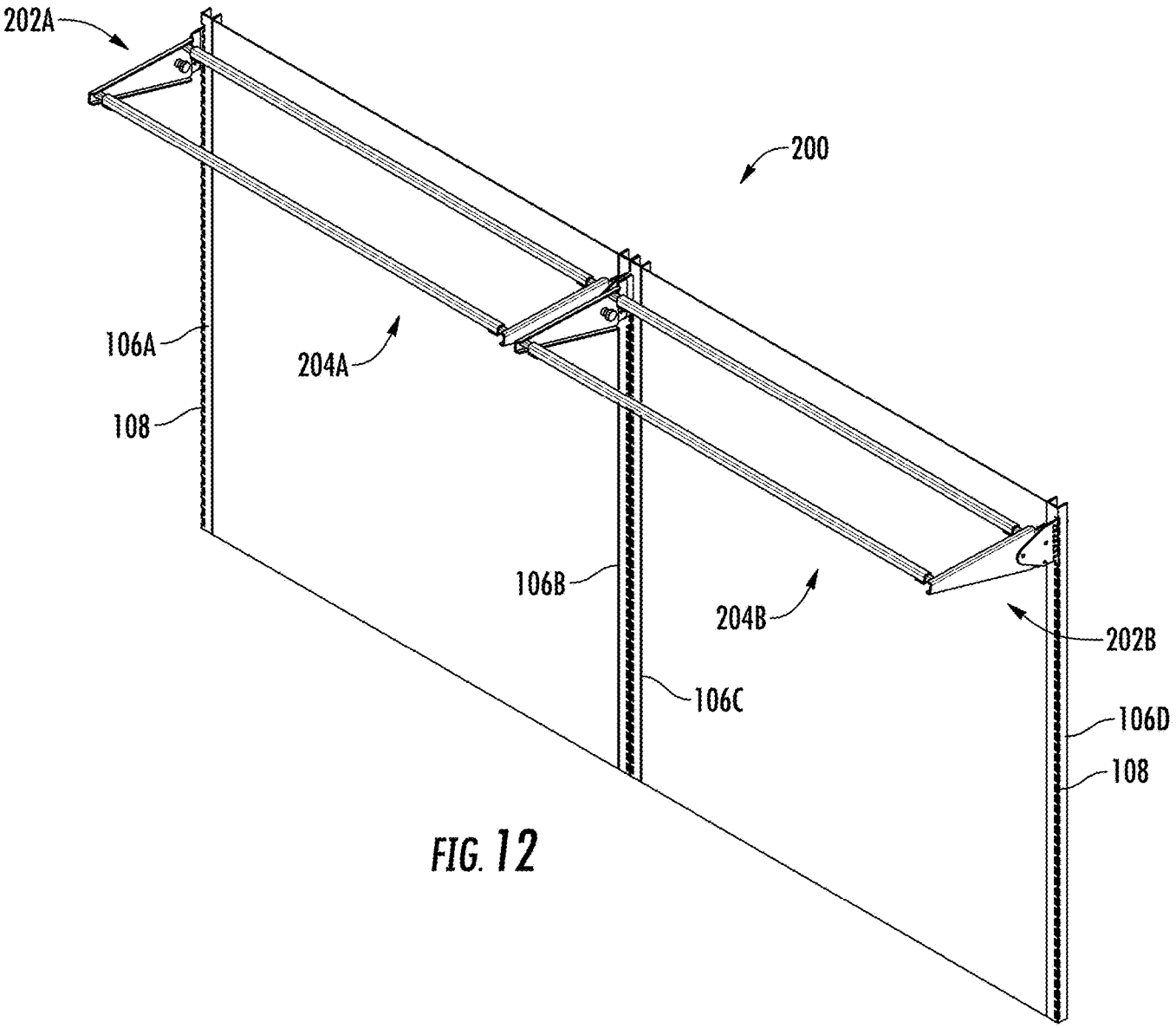
FIG. 12 is a front perspective view of an example of a retail merchandise display according to an example.

FIG. 12 illustrates a further embodiment of a shelf arrangement 200. The shelf arrangement includes shelves 202A and 202B. The shelves 102A, 102B each include a frame 104A, 104B and a top deck that is not illustrated in FIG. 12, but is similar to that illustrated in FIGS. 10 and 11 of the prior embodiment.

The uprights 106A-D and slots 108 are the same in shelf arrangement 200 as in shelf arrangement 100 described previously.

Shelves 202A and 202B are substantially identical so only a single shelf will be described but the features thereof will be universal between the two shelves 202A, 202B. Further, while two shelves 202A, 202B are illustrated, multiple shelves could be employed. Typically, there will be multiple vertically spaced shelves in the shelf arrangement 200.

Again, the shelves 202A, 202B, and particularly the frames 204A, 204B thereof are configured to promote easier cleaning of the frames 204A, 204B and particularly between the adjacent shelves 202A, 202B and more particularly without requiring removal of or limited removal of the components of frames 204A, 204B.

Figure 13:
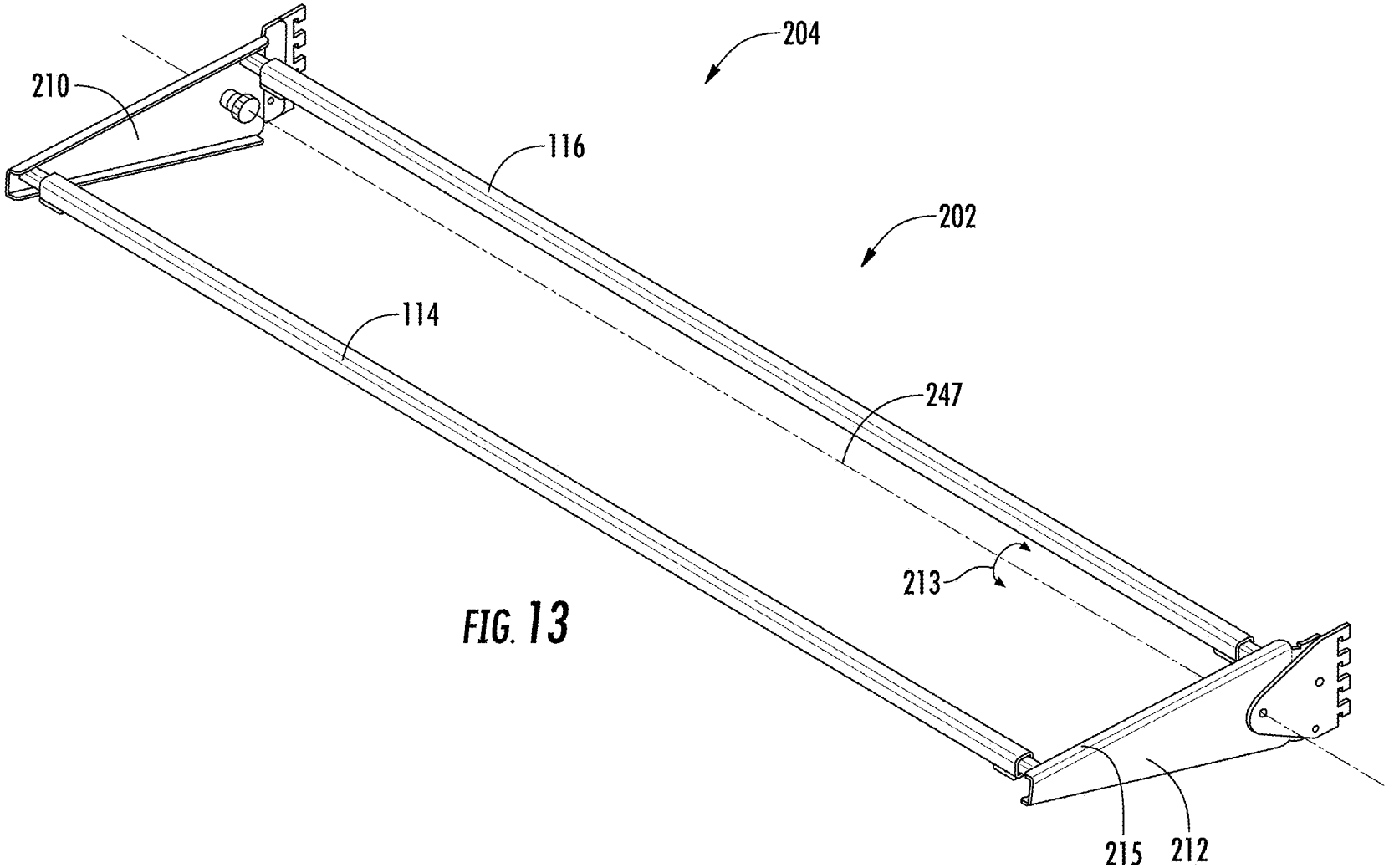
FIG. 13 is a front perspective view of a frame of a shelf of the retail merchandise display of FIG. 12.

FIG. 13 illustrates a frame 204 of a shelf 202 removed from the uprights 106. The frame 204 includes opposed brackets 210, 212 and a pair of support bars 114, 116. The opposed brackets 210, 212 are different than brackets 110, 112 of the shelf 104 of the prior embodiment. The support bars 114, 116 extend laterally between and interconnect brackets 210, 212 and are substantially identical to the support bars in shelf 104.

The brackets 210, 212 extend longitudinally between a front end and a rear end. This longitudinal direction is generally perpendicular to the front face of the uprights 106 and perpendicular to the lateral directions along which the support bars 114, 116 extend between adjacent brackets 210, 212 of a corresponding shelf 202.

The principle difference is that the brackets 210, 212 are adjustable to allow for different angles of the top surface 215 of the shelf 202. More particularly, each bracket 210, 212 includes a main body 220 and an adjustable mounting plate 222.

Figure 14:
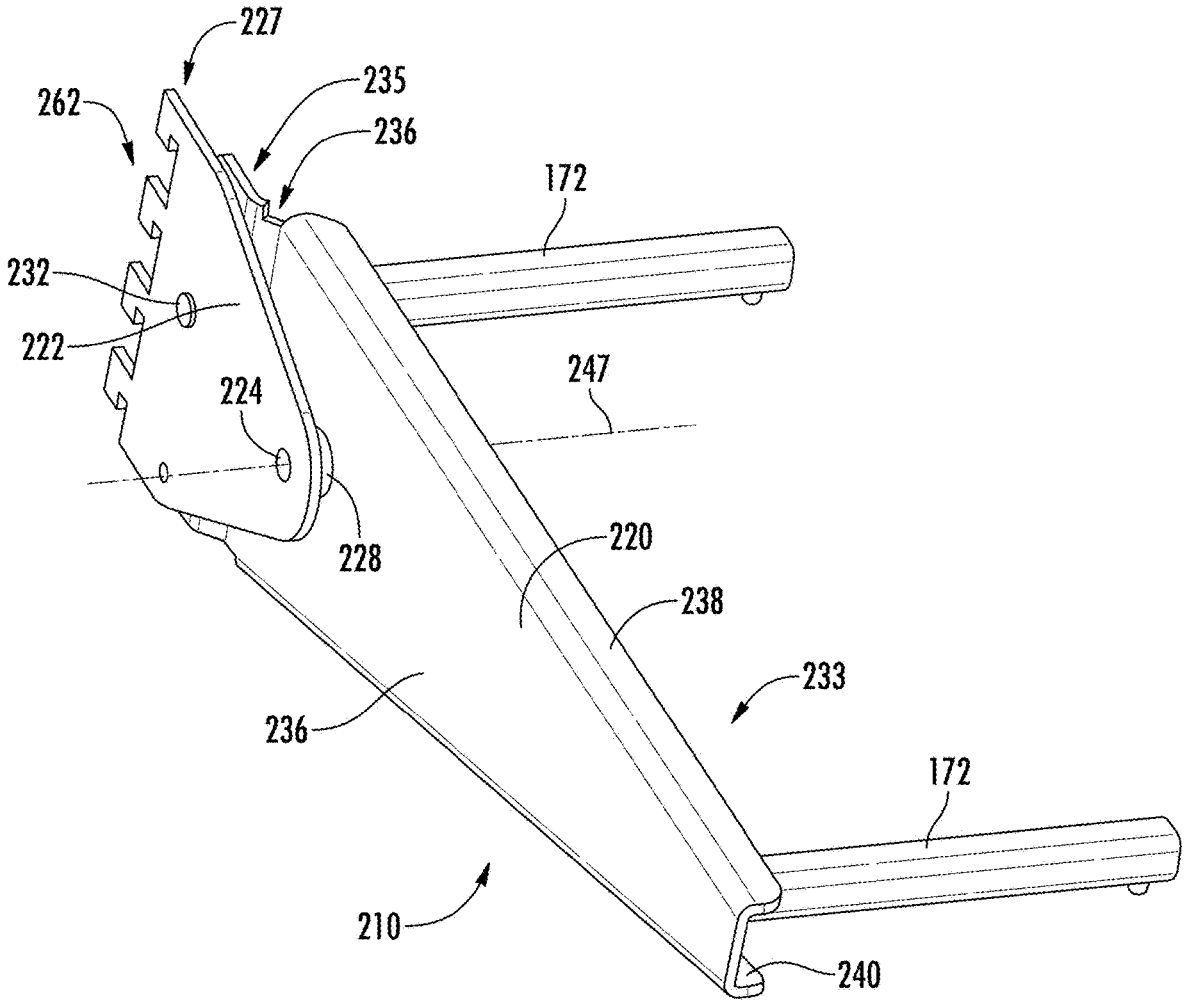
FIGS. 14 and 15 are perspective view of a bracket of the frame of FIG. 13.
Figure 15:
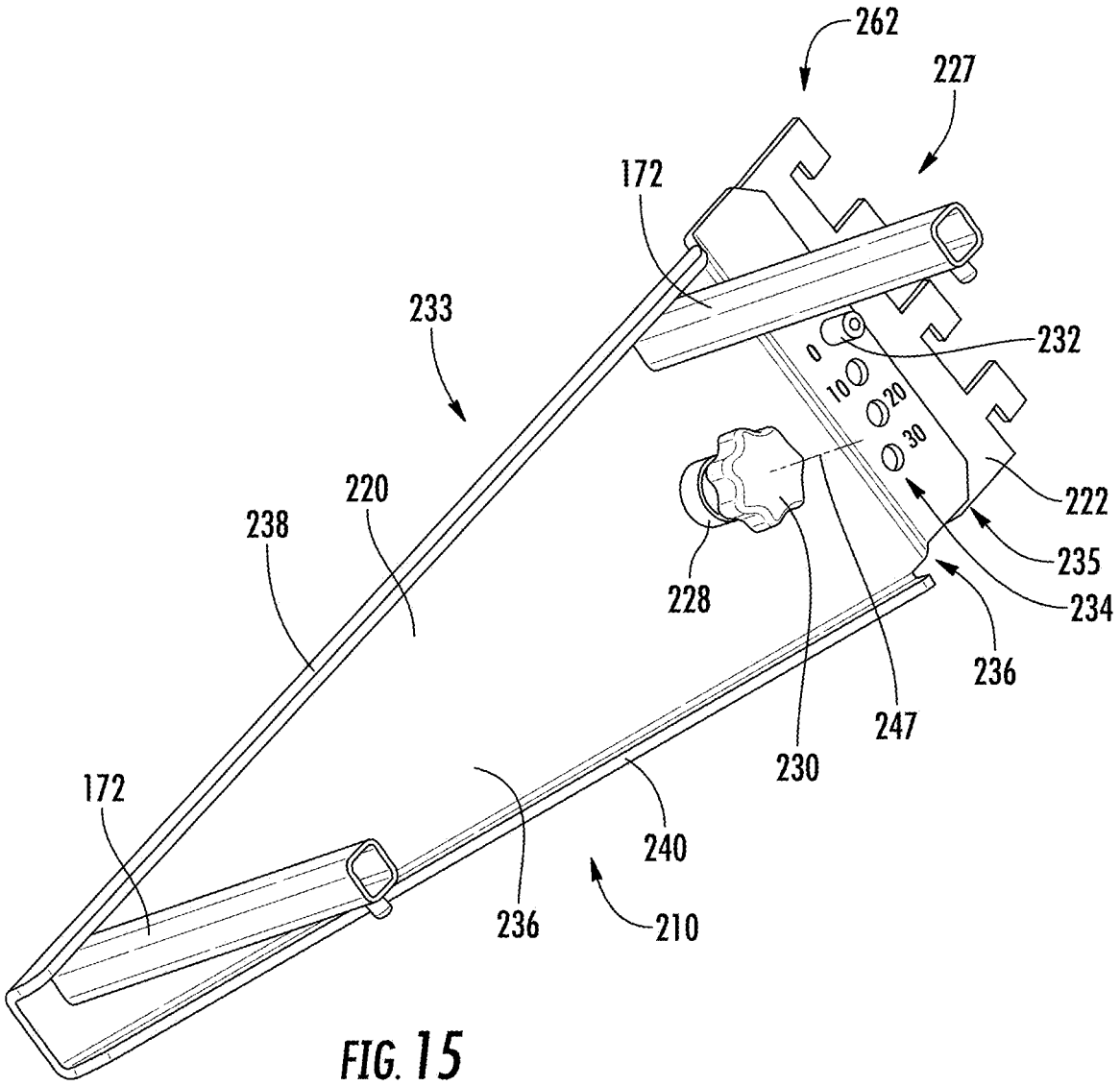
Figure 16:
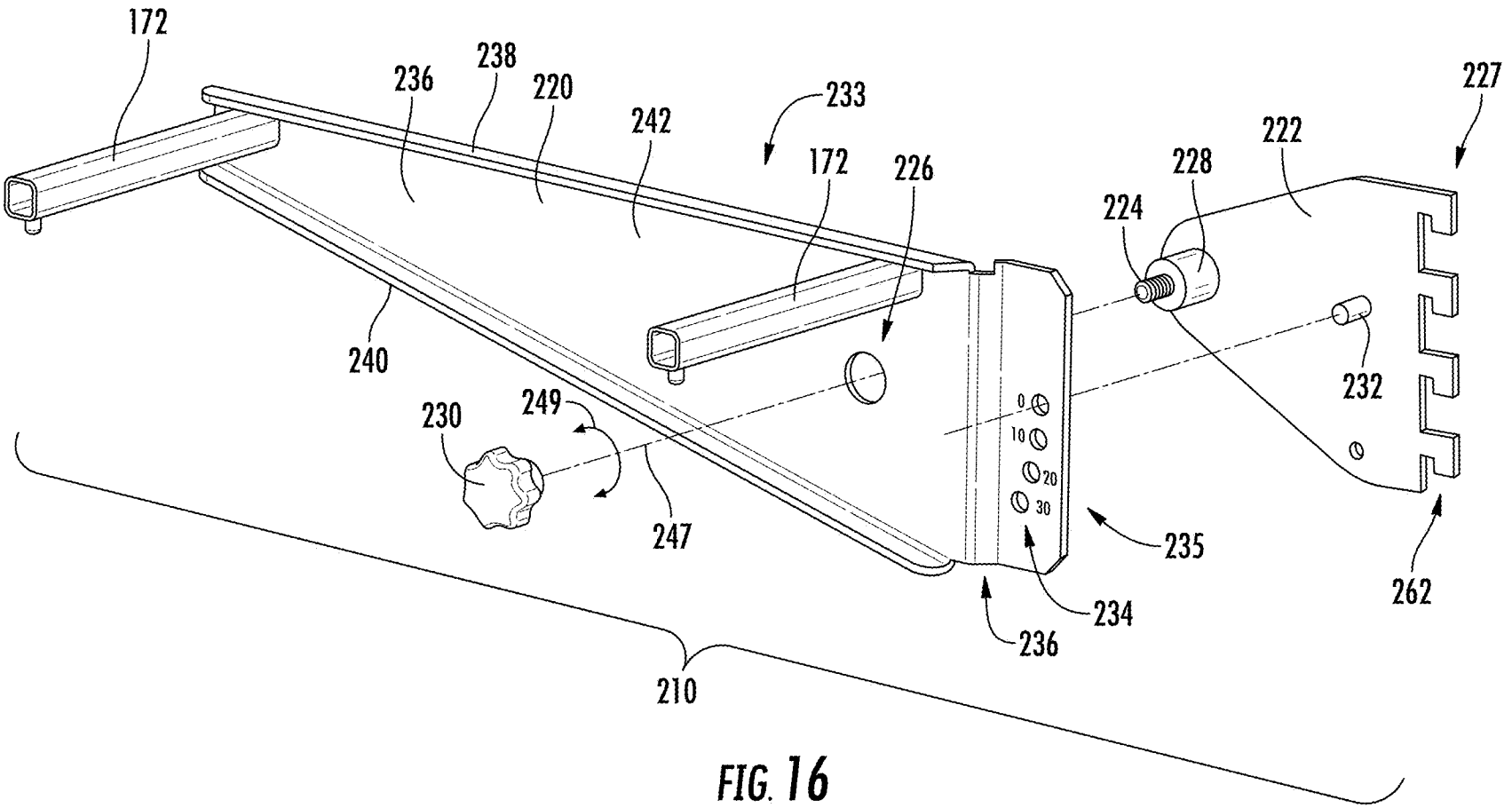
FIG. 16 is an exploded illustration of the bracket of FIGS. 14 and 15.

With reference now to FIGS. 14-16, one bracket 210 is illustrated. However, bracket 212 is a mirror image of bracket 210 so only a single bracket need be described. Bracket arm 210 includes a main body 220 and an adjustable plate 222 mounted to main body 220. Each mounting stub 172 is fixed to, and extends from, main body 220 as shown. Adjustable plate 222 attaches to main body 220 via a threaded fastener 224 as shown. Threaded fastener 224 extends through an aperture 226 of a bushing 228 of main body 220 and a thread knob 230 or the like may then be used to tighten main body 220 and adjustable plate 222 together.

Adjustable plate 222 also includes mounting structure 227 that includes mounting hooks 262 which are received in the apertures 108 of upright supports 106A-D. These mounting structures 227, however, can take any suitable form so as to facilitate the mounting of shelf 202 to any pre-existing structure.

Adjustable plate 222 also includes a pin 232 which is received in one of a plurality of apertures 234 formed in main body 220. The angular presentation of each bracket 210 as it extends outwardly in a cantilevered manner from its associated upright support 106A-D is governed by which of the apertures 234 pin 232 is received in. For example, when pin 232 is received in the upper most aperture 234, main body 220 is essentially level, e.g. horizontal/orthogonal to gravity, compared to adjustable plate 222. However, by removing any hardware securing fastener 230, one may reposition adjustable plate 222 relative to main body 220 (or vice versa) and insert pin 232 into a different one of apertures 234.

Here, the main body 220 pivots about axis 247 illustrated by arrow 249 in FIG. 16.

With brackets 110, 112, the mounting structure 126 was integrally formed with the rest of the brackets 110, 112. However, tilting can be accommodated depending on which of the notches of the hooks 162 that engages the uprights 106A-D.

Like in the prior embodiment, the mounting stubs 172 do not extend through the vertical flange portion 236 of the main body 220, again preventing debris from entering into the mounting stubs 172 from the external side of the main body 220. The main body 220 generally includes a support section 233 similar to support section 122 of the prior embodiment. In addition to the vertical flange portion, the support section also includes a top flange portion 238 and a bottom flange portion 240. The top flange portion 238 extends from an inner side 242 of the bracket 210 and from a top of the vertical flange portion 236. The bottom flange 240 extends from the inner side 242 of the bracket 210 and from a bottom of the vertical flange portion 236 such that the top and bottom flange portions 238, 240 are vertically spaced from one another.

The top and bottom flange portions 238, 240 extend from the vertical portion 236 a same direction that the transition section 236 offsets the support section 233 from section 235 that includes adjustment apertures 234. For an individual shelf, the transition section 236 offsets the support section 233 inward of offset section 235, e.g. toward the bracket on the other end of the shelf. Similarly, the top and bottom flange portions 238, 240 extend inward from the vertical flange portion 236, e.g. toward the bracket on the other end of the shelf.

Thus, as noted, the support section 233 is substantially the same as support section 122 of the prior embodiment, except for the pivoting ability relative to the adjustable plate 222.

In this embodiment, the adjustable plate 222 is positioned laterally outward from the main body 220 to which it is pivotably connected.

The adjustable plate 222 is substantially planar and vertically oriented to limit the amount of debris that may be caught thereby. Further, the vertically oriented planar body makes it easier to clean.

Figure 17:
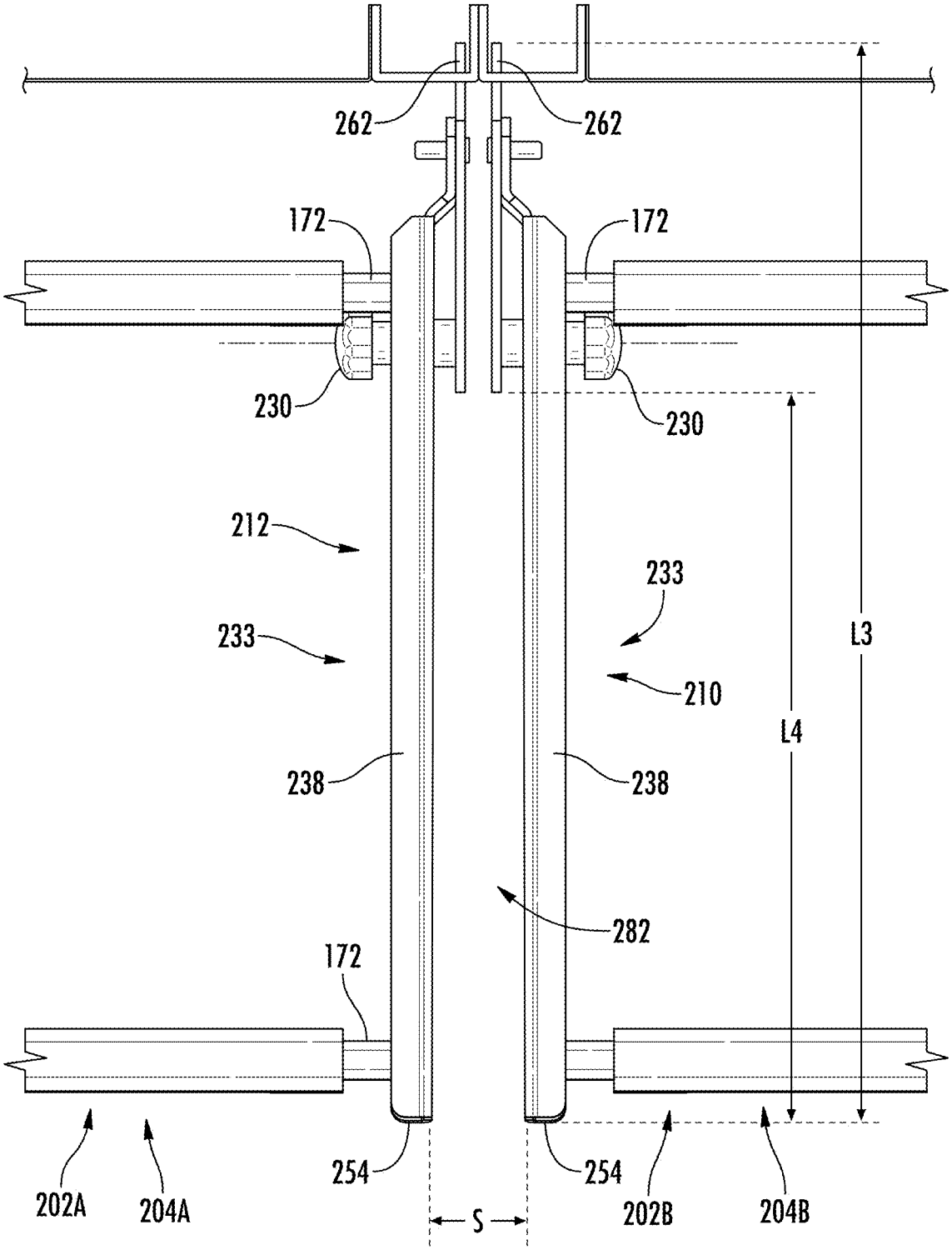
FIG. 17 is a top view of adjacent shelf brackets of adjacent shelves of the retail merchandise display of FIG. 12.

With reference to FIG. 17, the brackets 110, 112 have a length L3 from the rear end defined by the end of the hooks 262 to distal end 254. The support section 233 has a section offset from the end of mounting plate 222 that has a length L4 that is at least 60% of the length L3 and in some examples at least 75% of the length L3. This again provides an extended length of area where a large gap 282 is formed between the support sections 233 of the adjacent brackets 210, 212.

Further, the length of the flange 238 relative to the length from end 254 to the transition section 236 is preferably greater than 75%, even more preferably greater than 85% and even more preferably approximate at least 95% of the length from the transition section 236 to distal end 254.

As used herein reference numbers that include letters are specifically identified examples of the generic recitation of the reference numbers without letters (e.g. the uprights/shelves, brackets, discussed above).

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A shelf arrangement comprising:

spaced apart first and second brackets, each of the first and second brackets including a support section, each support section including a vertical flange portion, each vertical flange portion having a first side, the first side of the first bracket facing the second bracket and the first side of the second bracket facing the first bracket; and a support bar extending laterally between the vertical flange portion of the first bracket and the vertical flange portion of the second bracket, a first end of the support bar being an axially open end, the first end being attached to a region of the vertical flange portion of the first bracket and a second end of the support bar being an axially open end, the second end being attached to a region of the vertical flange portion of the second bracket, the region of the vertical flange portion of the first bracket is imperforate and is configured to prevent debris from axially entering the support bar through the first end of the support bar and the region of the vertical flange portion of the second bracket is imperforate and is configured to prevent debris from axially entering the support bar through the second end of the support bar; and wherein the first end of the support bar does not extend through the first bracket and the second end of the support bar does not extend through the second bracket; and a deck panel mounted to the support bar, the deck panel configured to extend laterally outward past the first side of the vertical flange portion of the first bracket while being mounted to the support bar.

2. The shelf arrangement of claim 1, wherein the first end of the support bar is tubular and the second end of the support bar is tubular.

3. The shelf arrangement of claim 1, wherein the first end of the support bar is welded to the first side of the vertical portion of the first bracket and the second end of the support bar is welded to the first side of the vertical portion of the second bracket.

4. The shelf arrangement of claim 1, wherein a portion of the support bar has an inverted U-shaped cross-section.

5. The shelf arrangement of claim 1, wherein the first end of the support bar is T-welded to the first side of the vertical portion of the first bracket and the second end of the support bar is T-welded to the first side of the vertical portion of the second bracket.

6. The shelf arrangement of claim 1, wherein:

the support bar includes first and second mounting stubs and a connection bar interconnected between the first and second mounting stubs;

the first and second mounting stubs are tubular elements;

an end of the first mounting stub is attached to the vertical flange portion of the first bracket such that the vertical flange portion of the first bracket closes off the end of the first mounting stub; and an end of the second mounting stub being attached to the vertical flange portion of the second bracket such that the vertical flange portion of the second bracket closes off the end of the second mounting stub.

7. The shelf arrangement of claim 1, further comprising a second support bar, the second support bar having first and second ends, the first end of the second support bar is attached to the vertical flange portion of the first bracket and the second end of the second support bar is attached to the vertical flange portion of the second bracket, the vertical flange portion of the first bracket closes off the first end of the second support bar and the vertical flange portion of the second bracket closes off the second end of the second support bar.

8. The shelf arrangement of claim 1, wherein at least the first end of the support bar is hollow and at least the second end of the support bar is hollow.

9. The shelf arrangement of claim 1, wherein:

the first bracket includes top and bottom flanges, the top and bottom flange portions extending from the vertical flange portion towards the second bracket, the top flange portion providing a top surface;

the top flange portion extending over the first end of the support bar; and the deck panel extends laterally outward over the top surface of the top flange portion.

10. The shelf arrangement of claim 1, wherein:

the first bracket includes top and bottom flanges, the top and bottom flange portions extending from the vertical flange portion towards the second bracket, the top flange portion providing a top surface and having an inner edge, the top flange portion extending between the inner edge and the vertical flange portion;

the top flange portion extending over the first end of the support bar; and the deck panel extends laterally outward beyond the inner edge of the top flange portion.

11. The shelf arrangement of claim 1, wherein:

the vertical flange portion having a second side opposite the first side that faces away from the second bracket; and the deck panel extends laterally outward beyond the second side of the first bracket.

12. A shelf arrangement comprising:

spaced apart first and second brackets, each of the first and second brackets including a support section, each support section including a vertical flange portion, each vertical flange portion having a first side, the first side of the first bracket facing the second bracket and the first side of the second bracket facing the first bracket;

a support bar extending laterally between the vertical flange portion of the first bracket and the vertical flange portion of the second bracket, a first end of the support bar being attached to a region of the vertical flange portion of the first bracket and a second end of the support bar being attached to a region of the vertical flange portion of the second bracket, the region of the vertical flange portion of the first bracket being configured to prevent debris from axially entering the support bar through the first end of the support bar and the region of the vertical flange portion of the second bracket being configured to prevent debris from axially entering the support bar through the second end of the support bar; and wherein:

the first end of the support bar is open and the region of the vertical flange portion of the first bracket closes the first end;

the second end of the support bar is open and the region of the vertical flange portion of the first bracket closes the second end; and a deck panel mounted to the support bar, the deck panel configured to extend laterally outward past the first side of the vertical flange portion of the first bracket while being mounted to the support bar.

13. The shelf arrangement of claim 12, wherein the first end of the support bar is tubular and the second end of the support bar is tubular.

14. The shelf arrangement of claim 13, wherein the region of the vertical flange portion of the first bracket proximate the first end of the support bar is imperforate and the region of the vertical flange portion of the second bracket proximate the second end of the support bar is imperforate.

15. The shelf arrangement of claim 12, wherein the first end of the support bar does not extend through the first bracket and the second end of the support bar does not extend through the second bracket.

16. The shelf arrangement of claim 12, wherein the first end of the support bar is welded to the first side of the vertical portion of the first bracket and the second end of the support bar is welded to the first side of the vertical portion of the second bracket.

17. The shelf arrangement of claim 12, further comprising a second support bar, the second support bar having first and second ends, the first end of the second support bar is attached to the vertical flange portion of the first bracket and the second end of the second support bar is attached to the vertical flange portion of the second bracket.

18. The shelf arrangement of claim 17, wherein the vertical flange portion of the first bracket closes off the first end of the second support bar and the vertical flange portion of the second bracket closes off the second end of the second support bar.

19. A shelf arrangement comprising:

spaced apart first and second brackets, each of the first and second brackets including a support section, each support section including a vertical flange portion, each vertical flange portion having a first side, the first side of the first bracket facing the second bracket and the first side of the second bracket facing the first bracket;

a support bar extending laterally between the vertical flange portion of the first bracket and the vertical flange portion of the second bracket, a first end of the support bar being attached to a region of the vertical flange portion of the first bracket and a second end of the support bar being attached to a region of the vertical flange portion of the second bracket, the region of the vertical flange portion of the first bracket being configured to prevent debris from axially entering the support bar through the first end of the support bar and the region of the vertical flange portion of the second bracket being configured to prevent debris from axially entering the support bar through the second end of the support bar; and wherein a portion of the support bar has an inverted U-shaped cross-section; and a deck panel mounted to the support bar, the deck panel configured to extend laterally outward past the first side of the vertical flange portion of the first bracket while being mounted to the support bar.

20. A shelf arrangement comprising:

spaced apart first and second brackets, each of the first and second brackets including a support section, each support section including a vertical flange portion, each vertical flange portion having a first side, the first side of the first bracket facing the second bracket and the first side of the second bracket facing the first bracket;

a support bar extending laterally between the vertical flange portion of the first bracket and the vertical flange portion of the second bracket, a first end of the support bar being attached to a region of the vertical flange portion of the first bracket and a second end of the support bar being attached to a region of the vertical flange portion of the second bracket, the region of the vertical flange portion of the first bracket being configured to prevent debris from axially entering the support bar through the first end of the support bar and the region of the vertical flange portion of the second bracket being configured to prevent debris from axially entering the support bar through the second end of the support bar;

wherein the first end of the support bar is welded to the first side of the vertical portion of the first bracket and the second end of the support bar is welded to the first side of the vertical portion of the second bracket; and wherein the first end of the support bar is T-welded to the first side of the vertical portion of the first bracket and the second end of the support bar is T-welded to the first side of the vertical portion of the second bracket; and a deck panel mounted to the support bar, the deck panel configured to extend laterally outward past the first side of the vertical flange portion of the first bracket while being mounted to the support bar.

21. A shelf arrangement comprising:

spaced apart first and second brackets, each of the first and second brackets including a support section, each support section including a vertical flange portion, each vertical flange portion having a first side, the first side of the first bracket facing the second bracket and the first side of the second bracket facing the first bracket;

a support bar extending laterally between the vertical flange portion of the first bracket and the vertical flange portion of the second bracket, a first end of the support bar being attached to a region of the vertical flange portion of the first bracket and a second end of the support bar being attached to a region of the vertical flange portion of the second bracket, the region of the vertical flange portion of the first bracket being configured to prevent debris from axially entering the support bar through the first end of the support bar and the region of the vertical flange portion of the second bracket being configured to prevent debris from axially entering the support bar through the second end of the support bar;

wherein:

the support bar includes first and second mounting stubs and a connection bar interconnected between the first and second mounting stubs;

the first and second mounting stubs are tubular elements;

an end of the first mounting stub is attached to the vertical flange portion of the first bracket such that the vertical flange portion closes off the end of the first mounting stub; and an end of the second mounting stub being attached to the vertical flange portion of the second bracket such that the vertical flange portion closes off the end of the second mounting stub; and a deck panel mounted to the support bar, the deck panel configured to extend laterally outward past the first side of the vertical flange portion of the first bracket while being mounted to the support bar.

22. The shelf arrangement of claim 21, wherein the first mounting stub is T-welded to the vertical flange portion of the first bracket and the second mounting stub is T-welded to the vertical flange portion of the second bracket.

23. A shelf arrangement comprising:

spaced apart first and second brackets, each of the first and second brackets including a support section, each support section including a vertical flange portion, each vertical flange portion having a first side, the first side of the first bracket facing the second bracket and the first side of the second bracket facing the first bracket;

a support bar extending laterally between the vertical flange portion of the first bracket and the vertical flange portion of the second bracket, a first end of the support bar being attached to a region of the vertical flange portion of the first bracket and a second end of the support bar being attached to a region of the vertical flange portion of the second bracket, the region of the vertical flange portion of the first bracket being configured to prevent debris from axially entering the support bar through the first end of the support bar and the region of the vertical flange portion of the second bracket being configured to prevent debris from axially entering the support bar through the second end of the support bar; and wherein at least the first end of the support bar is hollow and at least the second end of the support bar is hollow; and a deck panel mounted to the support bar, the deck panel configured to extend laterally outward past the first side of the vertical flange portion of the first bracket while being mounted to the support bar.

* * * * *